US005107082A

United States Patent [19]

Valenzona

[11] Patent Number: 5,107,082

[45] Date of Patent: Apr. 21, 1992

[54] DUAL LIGHTED ROCKER SWITCH EMBODYING A PRINTED CIRCUIT BOARD

[75] Inventor: Joseph F. Valenzona, El Toro, Calif.

[73] Assignee: Judco Manufacturing, Inc., Harbor City, Calif.

[21] Appl. No.: 464,128

[22] Filed: Jan. 10, 1990

[51] Int. Cl.[5] ..... H01H 21/36

[52] U.S. Cl. ..... 200/292; 200/315; 200/339; 361/395

[58] Field of Search ..... 200/292, 339, 313, 315, 200/316, 310, 311, 327, 293; 361/395, 399

[56] References Cited

U.S. PATENT DOCUMENTS

| | | | |
|---|---|---|---|
| 2,878,346 | 3/1959 | Andrews et al. | 200/315 |
| 3,749,873 | 7/1973 | Harper et al. | 200/293 |
| 3,996,431 | 12/1976 | Brown | 200/293 X |
| 4,169,972 | 10/1979 | Black, III et al. | 200/315 X |
| 4,340,791 | 7/1982 | Sorenson | 200/315 X |
| 4,425,487 | 1/1984 | Hsieh | 200/292 X |
| 4,496,813 | 1/1985 | Fukushima | 200/292 X |
| 4,516,007 | 5/1985 | Ringdahl et al. | 200/293 X |
| 4,667,073 | 5/1987 | Osika | 200/310 X |
| 4,778,967 | 10/1988 | Deng | 200/315 |
| 4,816,961 | 3/1989 | Saulgeot et al. | 200/293 |
| 4,843,200 | 6/1989 | Parlatore et al. | 200/339 X |
| 4,967,046 | 10/1990 | Priesemuth | 200/339 |

FOREIGN PATENT DOCUMENTS

| | | | |
|---|---|---|---|
| 845206 | 8/1979 | France | 200/293 |
| 1485770 | 9/1977 | United Kingdom | 200/315 |

*Primary Examiner*—Ernest G. Cusick
*Attorney, Agent, or Firm*—G. Norden Hanover

[57] ABSTRACT

A dual lighted rocker switch having a printed circuit board. Bi-pin terminated bulbs and conductive terminals are connected to a printed circuit board to form a sub-assembly. The sub-assembly is placed upon a cover, which is then slid in to place in a housing. The housing has a rib that acts as a stop to inhibit movement of a rocker which would cause the switch to short directly across the terminals of an external battery. The printed circuit board and cover improve the durability of the rocker switch. The printed circuit board is provided to make the assembly of the rocker switch easier. Thus the design of the switch provides for a reduction of cost and time in production of the rocker switch.

7 Claims, 2 Drawing Sheets

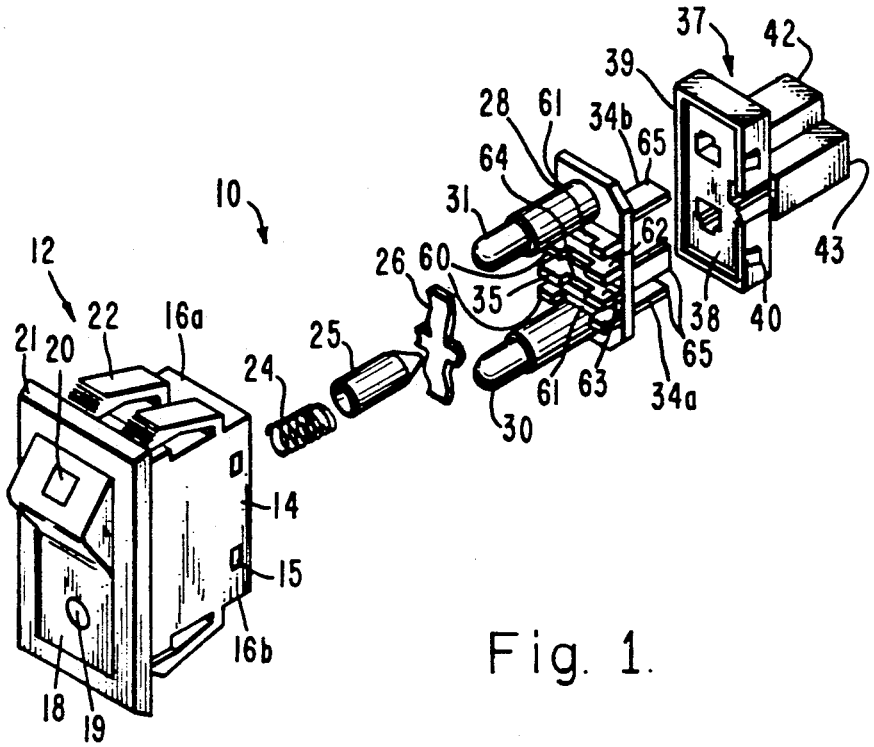
Fig. 1.
Fig. 2.
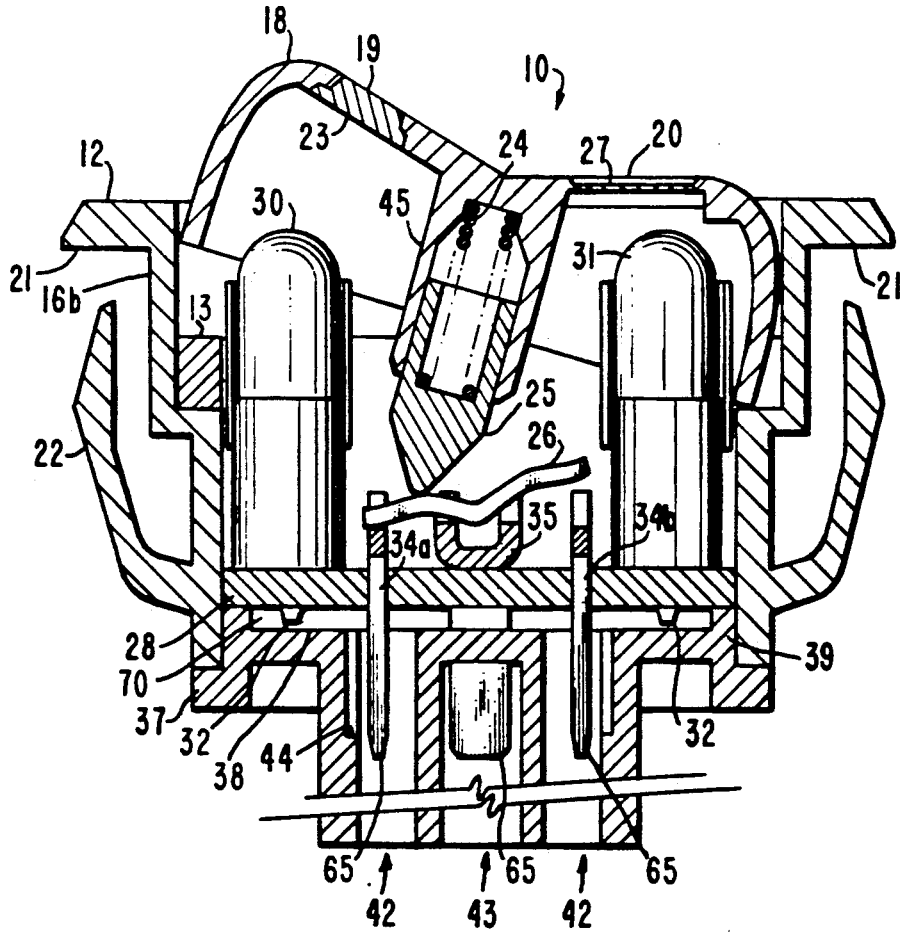

DUAL LIGHTED ROCKER SWITCH EMBODYING A PRINTED CIRCUIT BOARD

BACKGROUND

The present invention relates to the field of electrical switches and, more specifically, to an improvement in a dual lighted rocker switch.

Conventional dual lighted rocker switches are found most commonly in automotive applications, where they may be used to control headlamps or fog lamps for example, although their uses are not limited to these applications. Rocker switches of this kind are compact and difficult to assemble, so difficult in fact, that the precise movements required for a person to assemble a rocker switch have been likened to those of a watchmaker.

The assembly usually follows a pattern of first installing the light bulbs in a housing, which involves the tedious task of first tying the ground of one light bulb to the other by manually twisting the leads together, then feeding the light bulb leads into minute openings and positioning them. The second step may involve riveting leads from external connections to a hollow removable base with contacts on its sides. Once these leads are attached to the base, a horizontally movable contact is placed on top of the base for opening and closing the contacts of the switch. The final step involves spreading the leads from the light bulbs toward the sides of the housing, and inserting the removable base in such a way that allows the leads to fit tightly between the contacts and the housing wall, thus providing an electrical contact.

In view of these complexities and difficulties it is therefore an objective of the present invention to greatly reduce the difficulty of assembly of a dual lighted rocker switch. Another objective of this invention is to reduce the cost of these switches. A still further objective of the present invention is to provide a more durable rocker switch.

SUMMARY OF THE INVENTION

In accordance with these and other objectives and advantages of the present invention, there is provided a rocker switch comprising a printed circuit board, that allows quick and easy assembly of the internal component parts of the rocker switch. The internal parts to be assembled include light bulbs and the terminals which control the electrical opening and closing of the switch. The printed circuit board improves the ease of assembly by providing a base to which the light bulbs and terminals can be affixed before being placed into a switch housing. The upper ends of the terminals are designed to provide an electrical connection when a contact, that rocks or pivots transversely is placed on top and in contact with them. The bottom portions of the terminals provide for connection to external devices.

A feature of the present invention is the use of a cover that improves the ease with which the switch couples to external devices. The cover has one flat side that mates with the printed circuit board, the other side has three channels shaped to contain wire leads from external devices. Each channel contains a notch which provides for excellent coupling of wires to the terminals, as well as providing electrical isolation between them.

The switch of the present invention was designed for its use as a fog lamp switch, but the switch may be used in various other automotive applications. The present invention has a 7 ampere current rating, but has been successfully tested to 10 amperes.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is an exploded view of a dual lighted rocker switch according to the present invention;

FIG. 2 is a side view in cross section of the switch of FIG. 1 showing the interior thereof;

DETAILED DESCRIPTION

Figure 3:
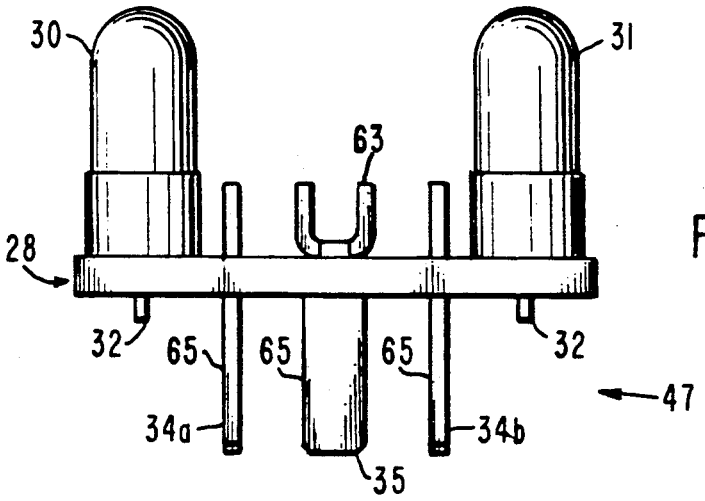
FIG. 3 is a side view of a printed circuit board subassembly employed in the switch of FIGS. 1 and 2, showing component parts mounted thereon.

Referring now to FIG. 1 of the drawings, there is shown an exploded view of a dual lighted rocker switch 10. A hollow, rectangular housing 12, having two wide sides 14, and two narrow sides 16*a*, 16*b*, which may be made of a material such as nylon plastic, for example, is adapted to house a rocker 18. Two pairs of opposing square openings 15 are located along the two wide sides 14 of the housing 12. On the narrow sides 16*a*, 16*b* of the housing 12 there are provided two pairs of clips 22 that coact with a shoulder 21 formed around the edge or perimeter of a face of the housing 12. This face is to the left as viewed in FIG. 1, and the shoulder is provided to allow for easy insertion and retention of the switch 10 in an instrument panel of an automobile, for example.

The rocker 18, which may be made of a material such as acetal plastic, for example, is coupled to the housing 12 by means of pins (not shown) molded onto it at the bottom of a shallow V portion of the rocker 18. The pins rest in openings of the housing 12. On top of the rocker 18 there is a small circular opening 19, and a small square shaped opening 20 used to transmit light provided by light bulbs 30, 31 which comprise a tell tale bulb 30 and a symbol bulb 31. A follower 25, that may be made of a material such as polycarbonate plastic, for example, is hollow at one end and is conical at another end. The hollow end is adapted to house a spring 24, and the conical end is adapted to cause a pivotal movement of contact 26.

Figure 4:
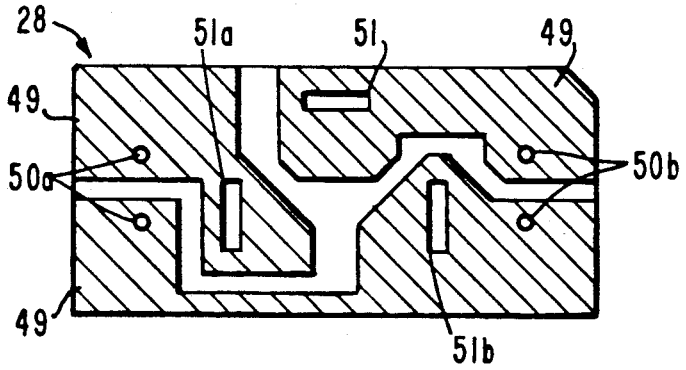
FIG. 4 is a bottom view of the printed circuit board of FIG. 3 without the components mounted thereon, showing the conductive copper circuit pattern.

Referring now to FIGS. 2 and 4, a printed circuit board 28 is shaped such that it fits into the base of the housing 12. The PC board 28 is comprised of commercially available PC board laminate that is etched on one side thereof having a lamination of conductive metal, such as copper for example, to form the desired circuit 49. The circuit 49 provides an electrical connection between devices disposed on the surface of the PC board 28. The PC board 28 has a number of openings disposed about its surface where electrical components may be placed for coupling to external devices, depending on the circuit configuration provided by the etched circuit. Parts employed on the PC board 28 are placed on the side opposite the side having the etched circuit 49, with their leads extending through openings thereon, and are wave or hand soldered into place.

Referring additionally to FIG. 3, light bulbs 30, 31 are disposed on the PC board 28 through openings in the PC board 28. The light bulbs 30, 31 have leads 32 which pass through the openings of the PC board 28 for coupling to the etched circuit. Closest to the inside of each light bulb 30, 31 is an end contact terminal comprising a tell tale terminal 34*a* and a common terminal 34*b*. Between the two end contact terminals 34*a* and 34*b* is a center switch contact terminal 35. The two end terminals 34*a* and 34*b* have flat, T shaped portions 60 made of a conductive metal, such as copper for example, with an elongated indentation along the center region thereof. The center terminal 35 is L shaped 62, with half of it being flat, and the other half comprising a U shaped portion along its side. The U shaped portion 63 of the center terminal 35 has an indentation 64 along its surface that coincides with the indentation 61 along the center regions of the end terminals 34*a* and 34*b*. The terminals 34*a*, 34*b* and 35 are disposed through openings in the PC board 28, such that the indents 61 of the end terminals 34*a* and 34*b* and the U shaped portion 63 of the center terminal 35, are located on the nonconductive side of the PC board 28, and the bottom portions of the terminals 34*a*, 34*b*, 35 form tabs 65 that extend through the PC board 28.

The moveable contact 26, made of a conductive material such as copper, for example, is disposed in the indentations 64 which are across the U shaped portion 63 of the center terminal 35. The moveable contact 26 is shaped with curvatures such that when the follower 25 moves transversely across its surface, it rocks or pivots in the center terminal 35, making contact with the tell tale terminal 34*a* when the switch is in its on position, and when the switch is in the off position, the contact 26 touches only the center terminal 35.

A rectangular cover 37, which may be made of a material such as nylon plastic for example, has a flat surface 38 which has a slight ridge 39 around its external periphery. The ridge 39 is adapted to mate to the PC board 28. A cavity 70 is formed by the ridge 39 and the flat surface 38 that provides a space for leads 32 of the light bulbs 30, 31. The cover 37 has four wedge locks 40 disposed on its outer surfaces for coupling to the square openings 15 in the housing 12. Opposite the flat surface 38 are two end channels 42, and a center channel 43, all of which have openings through the flat surface 38. The end channels 42 are substantially parallel with a space between them, and the third channel 43 spans the topmost area between the two end channels 42. The channels 42, 43 are formed such that they permit wires from external circuitry with non-insulated disconnects on their ends to couple to the tabs 65 of the terminals 34*a*, 34*b* and 35, while additionally providing electrical isolation between the terminals. The two end channels 42 provide isolation for the end terminals 34*a* and 34*b* and the top channel 43 provides isolation for the center terminal 35.

FIG. 2 is a cross sectional view of the dual lighted rocker switch 10, showing the interior thereof. On the inside portion of a narrow side 16*b* of the housing 12, there is located a rib 13. The rib 13 acts as a stop to prevent the rocker 18 from pivoting too far, which would cause the switch 10 to make a direct connection across the terminals 34*b* and 35, thereby causing a short circuit of a power source connected thereto, for example, an automotive battery. The switch 10 is adapted to be mounted in an instrument panel, for example, by pressing it into a mating opening until the shoulder 21 seats against the surface of the panel. The housing 12 is provided with locking clips 22 that are adapted to retain the switch 10 in place after it has been snapped into the opening.

The rocker 18 has a circular opening 19 and a square opening 20 for transmitting light from the light bulbs 30, 31. The circular opening 19 provides the location for a tell-tale sign 23, that may be made of a transparent material such as polycarbonate plastic, for example. The tell tale sign 23 has a round pattern and is disposed over the circular opening 19, both of which are disposed above one light bulb 30. This tell tale light bulb 30 is illuminated whenever the switch 10 is on. Above the square opening 20 there is provided a pattern, such as an international symbol 27 for fog lamps, disposed on its surface so that it is viewed when instrument panel lights, for example, are switched on. When the switch 10 is off, the square opening 20 transmits light to reveal the location of the switch 10 for its use. In the center of the rocker 18, there extends a channel 45 which houses the follower 25 and its spring 24. The compression of the spring 24 in the channel 45 is such that it allows the rocker 18 to slide the follower 25 across the surface of the contact 26 with the desired pressure, thus switching the switch 10 on and off by making and breaking electrical contact between terminals 34*a* and 35.

The cover 37 is mated to the bottom of the housing 12. The light bulbs 30, 31 have leads 32 that project beyond the PC board 28 after the light bulbs 30, 31 have been mounted thereon and soldered thereto. The ridge 39 of the cover 37 prevents the cover 37 from touching the leads 32 of the light bulbs 30, 31 when the cover 37 is snapped into place at the bottom of the housing 12. The end terminals 34*a* and 34*b* as well as the center terminal 35, pass through the PC board 28 and into their respective channels 42, 43. Each channel 42, 43 is an elongated hollow rectangle, and has a ledge 44 forestalls the unintentional removal of non-insulated disconnects (not shown) connect to terminals 34*a*, 34*b* and 35.

The arrangement of the terminals 34*a*, 34*b* and 35 is shown to illustrate how the U shaped portion 63 of the center terminal 35 enables the contact 26 to pivot on its ridges, with the aid of the follower 25. It would normally make contact with either terminal 34*a* or 34*b* if the rib 13 were not provided as a stop to limit the movement of the rocker 18. The PC board 28 is shown on top of the ridge 39 of the cover 37 inside the housing 12.

FIG. 3 is a side view of a PC board subassembly 47. The light bulbs 30, 31 are disposed on the outermost portions of the PC board 28, with their leads 32 projecting beyond of the bottom of the PC board 28. The leads 32 are of such a length to provide ease of soldering to the bottom of the PC board 28. Closest to the inside of each light bulb 30, 31 are the end terminals 34*a* and 34*b* shown with their tabs 65 extending well beyond the bottom of the PC board 28. The end terminals 34*a* and 34*b* are also connected to the PC board 28 by soldering. Between the two end terminals 34*a* and 34*b* is the center terminal 35. Its U shaped portion 63 and the relationship of its tab 65 with that of the end terminals 34*a*, 34*b* and may be seen clearly in this figure. The center terminal 35 is also soldered to the PC board 28 to provide electrical connection.

FIG. 4 is a view of the PC board 28 showing the configuration of a copper circuit 49. The copper circuit 49 that is disposed on the bottom surface of the PC board 28 provides for particular electrical connections of the devices disposed on the top surface thereof. Four round openings 50, two on the outermost portion of each end of the PC board 28 are provided for the leads 32 (not shown in this figure) of the light bulbs 30, 31 to pass through and be soldered to the copper circuit 49. Three rectangular openings 51 are provided for the tabs 65 of the terminals 34, 35 (not shown) to pass through, and that are employed for soldering to the copper circuit 49.

Figure 5:
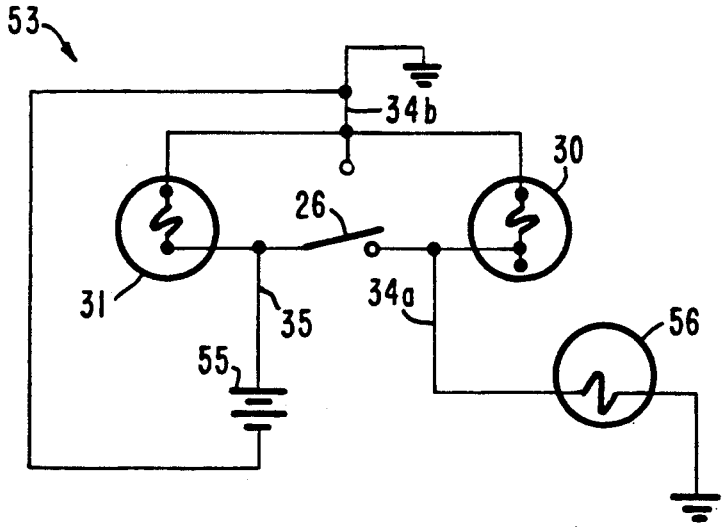
FIG. 5 is an electrical schematic diagram showing the switch of the present invention connected into a circuit with external battery and load.

FIG. 5 is an electrical schematic drawing of a circuit 53, showing the operation of the switch 10 when connected into an external circuit. A closed circuit is provided through a direct current (DC) power source, which may be an automotive battery 55, for example. The power source has a negative electrode tied to ground and a positive electrode connected to the light bulb 31. The light bulb 31, has its other terminal tied to ground, and is energized as long as the power source is connected to it. It is to be understood that, in an alternative embodiment, the closed circuit may be provided with external devices (not shown), such as an instrument panel light switch or an ignition switch, that connects and disconnects the power source.

Referring now to FIG. 1, the rocker switch 10 is shown in the off position, and only the symbol bulb 31 is illuminated. In FIG. 2, the rocker switch 10 is shown in the on position with the movable contact 26 making connection between the center terminal 35 and the tell tale terminal 34*a*. This causes both bulbs 30, 31 to be illuminated. FIG. 4 is a bottom view of the PC board 28. The surfaces of the PC board 28 shown with the hatching are those having the conductive copper circuit 49. The leads 32 of the tell tale bulb 30 are adapted to be inserted in the left pair of openings 50*a*, and the leads 32 of the symbol bulb 31 are adapted to be inserted in the right pair of openings 50*b*. The tell tale terminal 34*a* is adapted to be inserted in the left rectangular opening 51*a*, and the other terminal 34*b* is adapted to be inserted in the right rectangular opening 51*b*. The center terminal 35 is adapted to be inserted in the remaining rectangular opening 51. The leads 32 and terminals 34*a*, 34*b*, 35 are soldered to the copper circuit 49 of the PC board 28.

When the rocker switch 10 is in the off position and only the symbol bulb 31 is illuminated, the current enters the switch 10 through the common end terminal 34*b* and the rectangular opening 51*b*, passes through the symbol bulb 31, and exits the switch 10 through the center terminal 35 and its rectangular opening 51. When the switch 10 is in the on position, the movable contact 26 connects between the center terminal 35 and the tell tale terminal 34*a*. The heavy current to the external load flows directly through the contact 26, the center terminal 35 and the tale terminal 34*a*. In addition, a small current flows from the tell tale terminal 34*a* through the left rectangular opening 51*a*, through the tell tale bulb 30, and exits the switch 10 via the terminal 34*b* on the right and its rectangular opening 51*b*.

This explanation may be better understood in connection with the schematic circuit drawing of FIG. 5. The switch 10 is shown in the off position, and accordingly the current flows from the negative terminal of the battery 55 through the common terminal 34*b*, the symbol bulb 31, the center terminal 35 and back to the positive terminal of the battery 55. When the rocker switch 10 is in the on position, the movable contact 26 connects the center terminal 35 to the tell tale terminal 34*a*. Accordingly, in addition to the aforementioned current through the symbol bulb 31, current now flows from the negative terminal of the battery 55 through the tell tale bulb 30, the tell tale terminal 34*a*, the movable contact 26, the center terminal 35 to the positive terminal of the battery 55, and also from the negative terminal of the battery 55 through the fog lamp 56, the tell tale terminal 34*a*, the movable contact 26, the center terminal 35 to the positive terminal of the battery 55.

The rocker switch 10 has its center terminal 35 connected to the symbol light bulb 31, and an end terminal 34*a* to the tell-tale light bulb 30. The tell-tale light bulb 30 is in parallel with an external load, that may be a fog lamp 56, for example. When the switch 10 is open, the symbol bulb 31 is energized revealing the location of the switch. When the switch 10 is closed, the symbol light bulb 31 remains energized, and the tell-tale light bulb 30 and the load 56 become energized as well. Thus, when the switch 10 is closed the tell-tale light bulb 30 is lit, informing the user that the load, or fog lamp 56, for example, is also energized. A 7 ampere current which energizes the load does not pass through the copper circuit 49 of the PC board 28. Instead, that current passes through the terminals 34*a*, 35 and the contact 26 only, while the current which energizes the light bulbs 30, 31 is in the milliampere range and does pass through the copper circuit 49.

To assemble the rocker switch 10, the first step comprises fabricating the PC board subassembly 47. The fabrication of the PC board subassembly 47 comprises placing, in any sequence, the leads 32 of the light bulbs 30, 31 through their openings 50, the two end terminals 34*a* and 34*b* through their openings 51, the center terminal 35 through its opening 51 on the non-copper laminated side of the PC board 28, and then either wave or hand soldering the components to the copper laminated circuit 49 of the PC board 28. The second step comprises placing the contact 26 in its desired position across the terminals 34*a*, 34*b* and 35, and inserting the PC board subassembly 47, and contact 26 into the housing 12. The cover 37 is then inserted into the rear of the housing 12 and snapped into place using the wedge locks 40 and openings 15.

A rocker subassembly is formed wherein the spring 24 is press fitted into the internal portion of the follower 25 and also press fitted into the rocker 18, and this rocker subassembly is then inserted into the front opening of the housing 12. The rocker subassembly and housing are pressed together whereupon the rocker subassembly is locked into place by means of the pins (not shown) that engage openings in the housing 12. The lead assembly is then inserted through the cover 37 and locked into place by means of lock tabs that engage the interior ledge 44 of the cover 37.

This assembly compares favorably with the assembly procedure of the prior art switches which involves tying the leads of the light bulbs together by hand, then placing the light bulbs in a platform inside the conventional housing. Then wires are riveted to a base plate, and the leads of the light bulbs are aligned as the base is installed in the housing. This process is time consuming and not efficient when compared to the ease of assembly of the present invention. Accordingly the ease with which the dual lighted rocker switch 10 is assembled has been illustrated, showing how the present invention provides for a reduction in time required to assemble the switch 10, thus reducing the cost of production of the rocker switch 10.

Thus there has been described a new and improved dual lighted rocker switch having a printed circuit board. The printed circuit board provides for ease of assembly of the switch, thus reducing time and cost of production of the switch. The printed circuit board, cover, and rocker design also provide for improved durability. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A lighted rocker switch comprising:

a rectangular housing having a hollow cavity defined by opposite, longitudinally extending side walls;

a rib disposed in the internal periphery of the housing;

a rocker disposed in the housing for pivotal movement around a transverse axis and having a portion protruding outside the housing for controlling operation of the switch, the rocker having openings in its external surface for transmitting light, the rib acting as a stop to prevent the rocker from making undesired electrical contact between electrical terminals of the rocker switch;

a cover coupled to the bottom of the housing, the cover having an indented side comprising a flat surface with a ridge around its external periphery, and an opposite side having three generally elongated channels, wherein two of the three channels are spaced apart and the other channel spans the area between the two channels;

a printed circuit board disposed on the ridge around the indented side of the cover inside the housing, the printed circuit board having a plurality of openings disposed therethrough;

a plurality of light bulbs coupled to the printed circuit board at opposite ends of the printed circuit board for emitting light through the openings in the rocker;

a pair of end terminals disposed in the printed circuit board between the plurality of light bulbs, the end terminals having tabs for coupling to electronic circuitry, the end terminals having ridges thereon that provide for contact with a switching mechanism, a center terminal disposed between the pair of end terminals on the printed circuit board, the center terminal having a tab that provides for coupling to external electronic circuitry, the center terminal being adapted to couple to the switching mechanism;

a switching mechanism having a contact adapted for pivotal movement on a portion of the center terminal, the contact adapted to control conduction of the switch by providing an electrical connection between the center terminal and one end terminal; and a follower for providing pivotal movement of the contact, the follower having one end coupled to the rocker and the other end having a cone shape for controlling movement of the contact, the follower comprising a spring for controlling desired pressure between the rocker and the contact.

2. In a lighted rocker switch comprising a housing, a rocker, a plurality of light bulbs, a contact, and a follower, the improvement comprising:

a rib molded into an internal periphery of the housing, the rib preventing the switch from making a connection to other than the contact;

a printed circuit board subassembly, the subassembly providing for the electrical control of the rocker switch, the subassembly adapted to reside inside the housing; and a cover coupled to the bottom of the housing, the cover having an indented side comprising a flat surface with a ridge disposed around its external periphery, the ridge adapted to have the subassembly disposed thereon, the cover having an opposite side with three generally elongated channels, having two channels spaced evenly apart and the third channel spanning the area between the first two channels, the three channels providing for coupling to external electronic circuitry.

3. The lighted rocker switch of claim 2 in which the printed circuit board subassembly comprises:

a printed circuit board having an etched side comprising an electrical circuit that is adapted to provide electrical connection between electrical devices disposed on the printed circuit board, the printed circuit board having a plurality of openings disposed therein for coupling to the electrical devices.

the plurality of light bulbs being adapted to couple to the electrical circuit of the printed circuit board through the openings therein, the openings being disposed at opposite ends of the printed circuit board;

a pair of flat end terminals, the terminals having a T shape coupled to the electrical circuit between the light bulbs, the terminals having ridges on their ends, the surface between the ridges providing a location for an electrical contact of a switching mechanism; and a center terminal having a L shape coupled to the circuit of the printed circuit board at a generally central position of the printed circuit board, the center terminal having a U shaped region located along one side on its outer periphery, and wherein edges of the U shaped portion have ridges and have a contact transversely disposed therebetween.

4. The printed circuit board sub assembly of claim 3 in which all of the terminals are comprised of copper.

5. A rocker switch comprising:

a housing having a hollow cavity defined by opposite, longitudinally extending side walls;

a rocker disposed in the housing for pivotal movement around a transverse axis and having a portion protruding outside the housing for controlling operation of the swtich, the rocker having openings for transmitting light;

a cover coupled to the bottom of the housing, the cover having a plurality of channels that provide for coupling to electronic circuitry;

a printed circuit board disposed in the housing, and having a plurality of openings disposed therein;

a plurality of light bulbs conductively coupled to the printed circuit board for emitting light through the openings in the rocker;

a plurality of end terminals conductively coupled to the printed circuit board and having tabs for coupling to electronic circuitry, the plurality of end terminals having ridges for contact with a switching mechanism;

a center terminal coupled to the printed circuit board and having a tab that provides for coupling to electronic circuitry, the center terminal being adapted to couple to the switching mechanism;

a switching mechanism comprising a contact adapted for pivotal movement on the center terminal, and adapted to control the conduction of the switch by providing an electrical connection to the end terminals; and a follower for providing pivotal movement of the contact, and having one end coupled to the rocker and the other end coupled between the center terminal and the contact and adapted to control movement of the contact.

6. The rocker switch of claim 5 which further comprises:

a rib disposed in the housing that acts as a stop to prevent the rocker from making undesired electrical contact between electrical terminals of the rocker switch.

7. The rocker switch of claim 5 in which the printed circuit board comprises:

a printed circuit board disposed in the housing and having an etched side comprising an electrical circuit, that provides for electrical connection between electrical devices disposed thereon, the printed circuit board having a plurality of openings disposed therein for coupling to external devices;

the plurality of light bulbs being coupled to the electrical circuit of the printed circuit board through openings in the surface disposed at opposite ends of the printed circuit board;

wherein the pair of flat end terminals have a T shape and are coupled to the electrical circuit through openings disposed between the light bulbs, the terminals having ridges on their ends, the surface between the ridges providing a location for an electrical contact of a switching mechanism; and a center terminal coupled to the circuit of the printed circuit board through an opening therein, the opening being located at a generally central position of the printed circuit board, and having ridges on its ends and having a contact transversely disposed therebetween.

* * * * *